US006666388B2

(12) United States Patent
Ricco

(10) Patent No.: US 6,666,388 B2
(45) Date of Patent: Dec. 23, 2003

(54) PLUG PIN FOR AN INTERNAL COMBUSTION ENGINE FUEL INJECTOR NOZZLE

(75) Inventor: Mario Ricco, Casamassima (IT)

(73) Assignee: C.R.F. Societa Consortile per Azioni, Turin (IT)

( * ) Notice: Subject to any disclaimer, the term of this patent is extended or adjusted under 35 U.S.C. 154(b) by 104 days.

(21) Appl. No.: 09/814,230

(22) Filed: Mar. 21, 2001

(65) Prior Publication Data

US 2001/0054656 A1 Dec. 27, 2001

(30) Foreign Application Priority Data

Mar. 21, 2000 (IT) ..... TO2000A0269

(51) Int. Cl.[7] ..... F02M 61/20

(52) U.S. Cl. ..... 239/533.9; 239/533.3; 239/533.12

(58) Field of Search ..... 239/533.12, 533.9, 239/533.3

(56) References Cited

U.S. PATENT DOCUMENTS

| | | | | | |
|---|---|---|---|---|---|
| 2,927,737 | A | * | 3/1960 | Zeuch et al. | 239/533.3 |
| 4,934,599 | A | * | 6/1990 | Hasagawa | 239/533.8 |
| 5,211,340 | A | * | 5/1993 | Yoshizu | 239/443 |
| 5,890,660 | A | * | 4/1999 | Stevens | 239/533.3 |
| 6,247,452 | B1 | * | 6/2001 | Dittus et al. | 123/458 |
| 6,257,506 | B1 | * | 7/2001 | Hofmann et al. | 239/533.12 |

FOREIGN PATENT DOCUMENTS

| | | |
|---|---|---|
| DE | 19820513 A1 | 11/1999 |
| DE | 19844638 A1 | 3/2000 |
| EP | 0 520 659 A1 | 12/1992 |

* cited by examiner

*Primary Examiner*—Steven J. Ganey
(74) *Attorney, Agent, or Firm*—Pennie & Edmonds LLP

(57) ABSTRACT

The nozzle has a conical wall with injection orifices; the pin has a tip activated by an axial force to engage the wall and close the orifices; the tip has a truncated-cone-shaped portion having an outer surface which rests entirely on the wall, possibly as a result of elastic deformation of the outer surface; and the outer surface forms with the wall a substantially zero angle with a tolerance of 0' to ±10'.

10 Claims, 2 Drawing Sheets

PLUG PIN FOR AN INTERNAL COMBUSTION ENGINE FUEL INJECTOR NOZZLE

The present invention relates to a plug pin for an internal combustion engine fuel injector nozzle.

BACKGROUND OF THE INVENTION

In known injectors, the nozzle is normally defined by a body having a conical wall with a number of fuel injection orifices; and the pin has a conical tip which closes the orifices by virtue of an axial force normally resulting from the force of a spring and the difference in fuel pressure on the pin and a control rod.

The conical tip of known pins is connected to a cylindrical portion of the pin by a truncated-cone-shaped portion, the outer surface of which forms, with the outer surface of the conical tip, an annular edge engaging a circumference of the nozzle wall to close the orifices and which is obviously subject to wear.

A drawback of known pins of the above type is that wear on the edge contacting the nozzle wall also shifts the contact circumference on the wall, thus also altering the closed position of the pin and consequently the travel or lift of the pin between the closed and open positions.

Moreover, the contact circumference gradually increases in diameter, so that, for a given opening travel of the pin, the amount of fuel injected also varies alongside wear. Consequently, the amount of fuel injected by the various injectors on the engine differs according to the different degrees of wear on the edges of the respective pins.

SUMMARY OF THE INVENTION

It is an object of the invention to provide a plug pin for an injector nozzle, which is extremely straightforward and cheap to produce, while at the same time ensuring constant fuel injection for a given lift of the pin to eliminate the aforementioned drawbacks typically associated with known pins.

According to the present invention, there is provided a plug pin for an internal combustion engine fuel injector nozzle, wherein said nozzle has a conical wall with orifices for injecting fuel, and wherein said pin comprises a tip for closing said orifices; an axial force acting on said pin to cause said tip to engage said wall at a portion adjacent to said orifices; and the pin being characterized in that said tip comprises a truncated-cone-shaped portion having an outer surface resting entirely on said wall.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
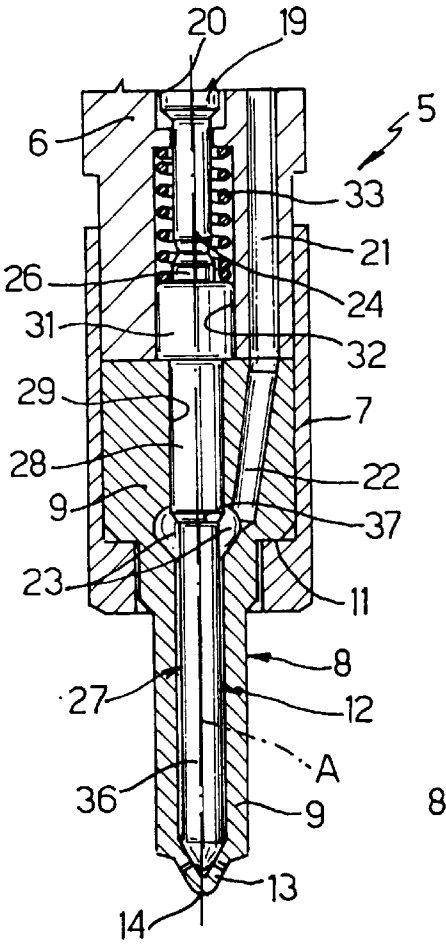
FIG. 1 shows a half section of a fuel injector featuring a pin for plugging the nozzle.

Number 5 in FIG. 1 indicates as a whole a fuel injector for an internal combustion, e.g. diesel. engine. Injector 5 comprises a hollow body 6 connected by a ring nut 7 to a nozzle indicated as a whole by 8 and in turn comprising a body 9 having a shoulder 11 engaged by ring nut 7.

Body 9 of nozzle 8 has an axial hole 12 and terminates with a seat defined by a conical wall 13 having a rounded vertex 14. A circumferential portion 16 (FIG. 2) of conical wall 13 has a number of injection orifices 17: advantageously, four orifices 17 equally spaced angularly and each having an axis 18 perpendicular to wall 13.

Hollow body 6 (FIG. 1) has an axial hole 20 in which slides a control rod 19 controlled by the pressurized fuel inside a control chamber (not shown) having a metering valve controlled by an electromagnet. The pressurized fuel is fed along a feed conduit 21 in body 6 and along a feed conduit 22 in nozzle 8 to an annular injection chamber 23 formed about axial hole 12 in nozzle 8.

One end 24 of rod 19 engages an appendix 26 of a pin 27 for closing orifices 17 and which slides inside axial hole 12. More specifically, pin 27 has an axis A and comprises a cylindrical portion 28 guided in fluidtight manner inside a portion 29 of hole 12 in nozzle 8; portion 28 of pin 27 terminates at one end with a collar 31 supporting appendix 26 and which is guided inside a cylindrical seat 32 coaxial with hole 20 in body 6; and collar 31 is normally pushed towards nozzle 8 by a compression spring 33.

Pin 27 also comprises another cylindrical portion 36 connected to portion 28 by a shoulder 37 on which the pressurized fuel in chamber 23 acts. With respect to a cylindrical surface 35 of hole 12 in nozzle 8 (FIG. 2), portion 36 of pin 27 has a given clearance to ensure fast fuel flow from chamber 23 to orifices 17 of nozzle 8.

Figure 2:
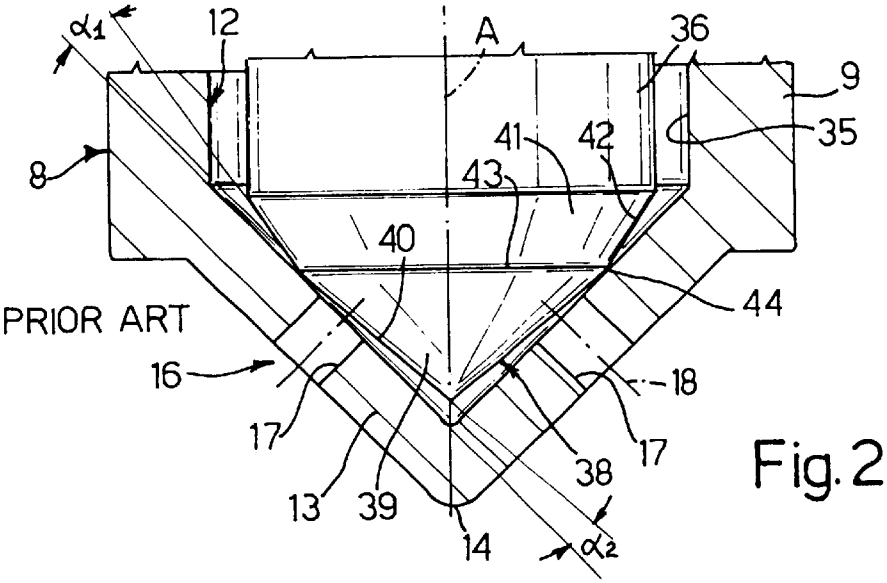
FIG. 2 shows a larger-section portion of FIG. 1 according to the prior art.

Pin 27 also has a substantially conical tip 38 connected to one end of portion 36 and comprising a conical portion 39 having an outer surface 40 engaging conical wall 13 of body 9 to close orifices 17. In known injectors as shown in FIG. 2, conical portion 39 of tip 38 is normally connected to cylindrical portion 36 of pin 27 by a truncated-cone-shaped portion 41 having an outer surface 42 forming an annular edge 43 with outer surface 40 of conical portion 39; outer surface 42 of truncated-cone-shaped portion 41 forms an angle al with conical wall 13 of nozzle 8; and outer surface 40 of portion 39 forms an angle $\alpha 2$ with conical wall 13.

Rod 19 and spring 33 (see also FIG. 1) push edge 43 to engage a contact circumference 44, upstream from orifices 17, on conical wall 13 of nozzle 8, so that tip 38 closes orifices 17. Inevitable wear of edge 43 shifts circumference 44 on wall 13 of nozzle 8, thus also altering the closed position of pin 27 and the travel or lift of pin 27 between the closed and open positions.

Figure 3:
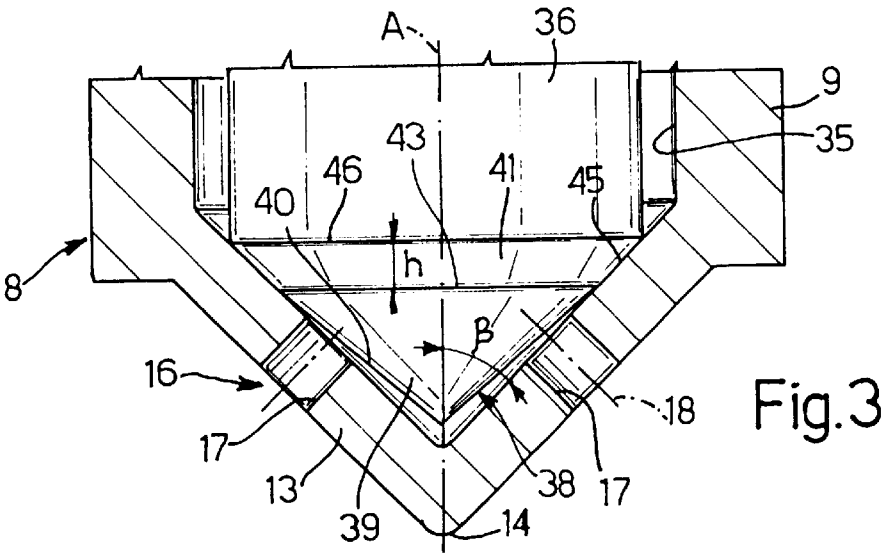
FIG. 3 shows the FIG. 2 portion according to the invention.

According to the invention, truncated-cone-shaped portion 41 has an outer surface 45 (FIG. 3) resting entirely on wall 13, so that sealing does not depend solely on edge 43. Surface 45 of portion 41 may rest on wall 13 as a result of elastic deformation produced by the force of spring 33 and by the difference in fuel pressure acting on rod 19 and shoulder 37.

More specifically, surface 45 of portion 41 is designed to form with wall 13 a substantially zero angle with a tolerance of 0' to ±10'. Consequently, when pin 27 is moved into the closed position, contact between surface 45 of portion 41 and wall 13 commences either at an edge 46 between truncated-cone-shaped surface 45 and the cylindrical surface of portion 36, or at edge 43 between surface 45 and surface 40 of conical portion 39; and the closing force acting on pin 27 deforms surface 45 so that it rests entirely on wall 13, as shown by the continuous lines in FIG. 3.

The vertex angle α of conical wall 13, i.e. the angle formed between a generating line of the inner surface of wall 13 and axis A, advantageously ranges between 45° and 75°; and truncated-cone-shaped portion 41 may be of a height h of 0.12 to 0.18 mm-preferably 0.15 mm-to obtain a given size of the contact surface between pin 27 and wall 13.

Figure 4:
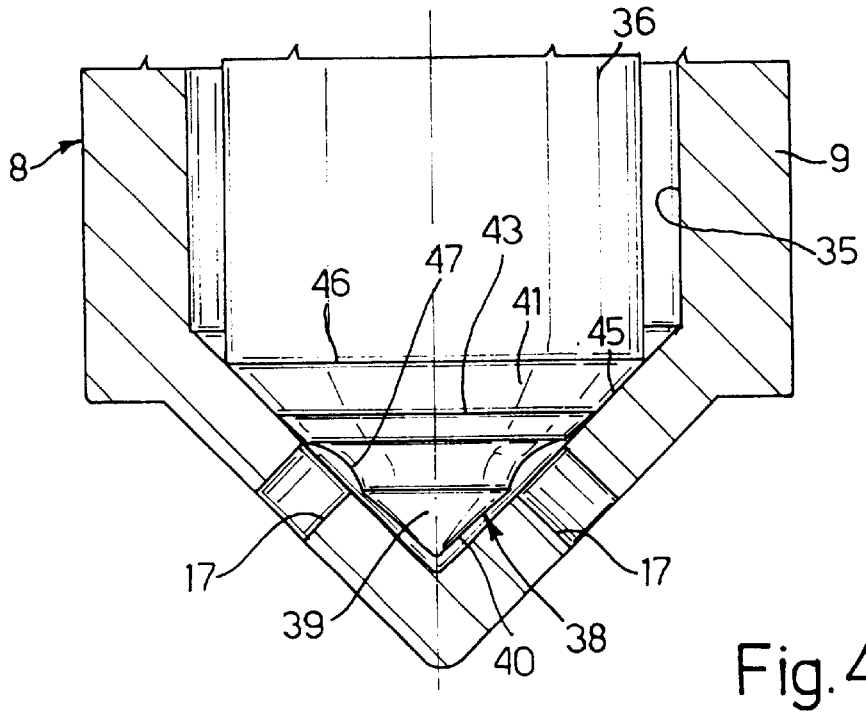
FIG. 4 shows a first variation of the FIG. 3 portion.
Figure 5:
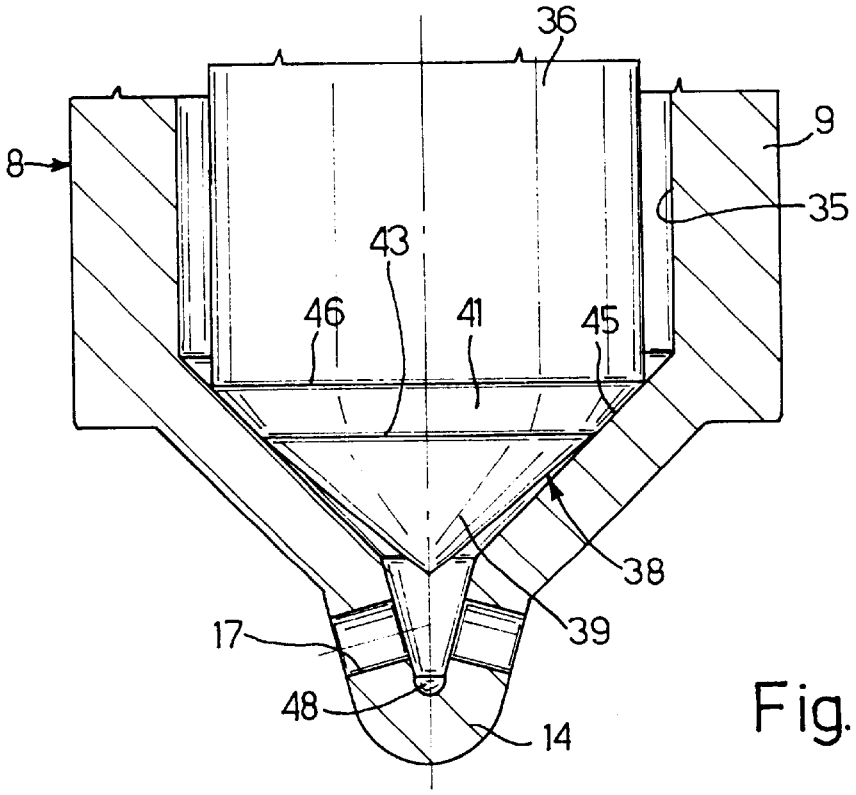
FIG. 5 shows a second variation of the FIG. 3 portion.

Adjacent to orifices 17, a recess may be provided between tip 38 of pin 27 and wall 13 of nozzle 8 to collect a certain amount of fuel and ensure uniform flow through orifices 17, even in the event of slight misalignment of pin 27. In the FIG. 4 variation, surface 40 of portion 39 has an annular recess 47 opposite orifices 17; and, in the FIG. 5 variation, the recess is defined by a basin 48 at the vertex of wall 13 of nozzle 8.

The advantages, with respect to known pins, of the pin according to the invention will be clear from the foregoing description. That is, wear of edge 43 is negligible, and the working life of pin 27 is greatly increased with no need for adjustment.

Clearly, changes may be made to the pin as described herein without, however, departing from the scope of the accompanying claims. For example, annular recess 47 may be formed in wall 13, or partly in wall 13 and partly in surface 40 of portion 39 of tip 38.

What is claimed is:

1. A plug pin for an internal combustion engine fuel injector nozzle, said nozzle comprising a conical wall with orifices for injecting fuel, said plug pin comprising a tip adapted to engage said wall at a portion adjacent to said orifices for closing said orifices upon the action of an axial force;

wherein said tip comprises a truncated-cone-shaped portion having an outer surface resting entirely on said wall;

wherein said truncated-cone-shaped portion has a height ranging between about 0.12 mm and about 0.18 mm;

wherein said orifices are spaced uniformly about said wall; and wherein a recess is provided adjacent to said orifices to collect a given amount of fuel and ensure uniform fuel flow through said orifices, said recess being located on a conical portion of said tip opposite said orifices; said recess being annular.

2. The pin as claimed in claim 1, wherein said outer surface of said truncated-cone-shaped portion rests entirely on said wall as a result of elastic deformation produced by said force.

3. The pin as claimed in claim 1, wherein said outer surface of said truncated-cone-shaped portion is designed to form with said wall a substantially zero angle with a tolerance of about 0' to about ±10 '.

4. The pin as claimed in claim 1, wherein said conical wall has a vertex angle of about 45° to about 75 °.

5. The pin as claimed in claim 1, wherein said wall has a vertex; and wherein said recess is defined by a basin located at said vertex of said wall.

6. A plug pin for use in an internal combustion engine fuel injector that has a nozzle, said nozzle comprising a conical wall with orifices for injecting fuel, said plug pin comprising a tip adapted to engage said wall at a portion adjacent to said orifices for closing said orifices upon the action of an axial force;

wherein said tip comprises a truncated-cone-shaped portion having an outer surface resting entirely on said wall;

wherein said conical wall has a vertex angle in the range of from about 45° to about 75 °;

wherein said orifices are spaced uniformly about said wall; and wherein a recess is provided adjacent to said orifices to collect a given amount of fuel and ensure uniform fuel flow through said orifices, said recess being located on a conical portion of said tip opposite said orifices; said recess being annular.

7. The pin as claimed in claim 6, wherein said outer surface of said truncated-cone-shaped portion rests entirely on said wall as a result of elastic deformation produced by said force.

8. The pin as claimed in claim 6, wherein said outer surface of said truncated-cone-shaped portion is designed to form with said wall a substantially zero angle with a tolerance of about 0' to about ±10 '.

9. The pin as claimed in claim 6, wherein said truncated-cone-shaped portion has a height ranging between about 0.12 mm and about 0.18 mm.

10. The pin as claimed in claim 6, wherein said wall has a vertex; and wherein said recess is defined by a basin located at said vertex of said wall.

* * * * *